US006086509A

United States Patent [19]

Johnson et al.

[11] Patent Number: 6,086,509

[45] Date of Patent: Jul. 11, 2000

[54] METHOD AND APPARATUS FOR TRANSMISSION CLUTCH MODULATION DURING GEAR SHIFT BASED ON PAYLOAD AND SELECTED DIRECTION

[75] Inventors: Larry Alan Johnson, Burlington, Iowa; David Langsford Collins, Bolingbrook, Ill.

[73] Assignee: Case Corporation, Racine, Wis.

[21] Appl. No.: 09/336,880

[22] Filed: Jun. 18, 1999

[51] Int. Cl.[7] ..... F16H 59/52

[52] U.S. Cl. ..... 477/97; 477/900; 172/2

[58] Field of Search ..... 477/900, 97; 74/335; 172/2, 3, 10; 37/348, 442; 414/699; 701/50

[56] References Cited

U.S. PATENT DOCUMENTS

| | | | |
|---|---|---|---|
| 4,800,660 | 1/1989 | Masao | 37/442 X |
| 4,836,057 | 6/1989 | Asayama et al. | 477/900 X |
| 4,919,222 | 4/1990 | Kyrtsos et al. | 177/139 |
| 5,116,187 | 5/1992 | Fukuda et al. | 414/699 |
| 5,212,998 | 5/1993 | Testerman | 74/335 |
| 5,450,768 | 9/1995 | Bulgrien et al. | 74/336 R |
| 5,474,147 | 12/1995 | Yesel et al. | 701/50 X |
| 5,528,499 | 6/1996 | Hagenbuch | 701/50 |
| 5,528,843 | 6/1996 | Rocke | 37/348 |
| 5,529,134 | 6/1996 | Yomogita | 701/50 X |
| 5,535,124 | 7/1996 | Hosseini et al. | 701/50 X |

*Primary Examiner*—Charles A Marmor
*Assistant Examiner*—Ankur Parekh
*Attorney, Agent, or Firm*—Foley & Lardner

[57] ABSTRACT

In a vehicle, such as a construction vehicle, which has a payload of variable but significant weight with respect to the empty weight of the vehicle, a sensor senses the weight of the payload and transmits a signal representative thereof to a processor. The processor modulates clutch transmission fluid pressure as a function of the payload, permitting more uniform operating characteristics. The sensor can be a hydraulic fluid pressure sensor installed in a hydraulic cylinder used to lift a payload bucket arm.

14 Claims, 3 Drawing Sheets

METHOD AND APPARATUS FOR TRANSMISSION CLUTCH MODULATION DURING GEAR SHIFT BASED ON PAYLOAD AND SELECTED DIRECTION

TECHNICAL FIELD OF THE INVENTION

The present invention relates in general to the modulation of clutch pressure on hydraulic transmissions, and more particularly to a method and apparatus for modulating clutch pressure on vehicles having payloads of substantial and variable weight.

BACKGROUND OF THE INVENTION

Certain construction vehicles, such as backhoes, end loaders, pans and other earthmovers, have maximum payloads which are a substantial part of the gross weight of the vehicle. These vehicles are often driven with a full payload and subsequently with no payload, causing the operator to experience a sharp difference in driving characteristics. For example, in a routine end loader operation, the operator acquires a bucketful of earth and then carries it to a second location. At the second location, the operator dumps the bucket and then in an empty condition returns to the first location to dig more earth.

One of the vehicle handling problems caused by the weight variation relates to putting the vehicle in gear to go from one location to the other. The transmission in such vehicles is more or less gradually engaged by use of a clutch. The transmission control valve controls application of hydraulic fluid pressure to the transmission clutch. On the one hand, engagement of the transmission under empty-load conditions should not be too jerky or abrupt, or degradation of operator control of the vehicle could result. On the other hand, actuation of the clutch under full-load conditions should not be so gradual that the controls feel sluggish. Acceptable handling characteristics under these two conditions are often difficult if not impossible to obtain by use of conventional transmissions and clutches. A need therefore persists for transmission/clutch arrangements which are not too jerky under empty load and are acceptably responsive under full load.

SUMMARY OF THE INVENTION

According to one aspect of the invention, a clutch modulation system for a vehicle includes a sensor on a payload-carrying component of the vehicle, such as a bucket in an end loader. The sensor generates a signal indicative of the weight of the payload; in the illustrated embodiment, what is sensed is the hydraulic pressure in an actuation cylinder of a bucket arm, which will vary according to the mass of the payload present in the bucket. A clutch controller receives this signal and selects, from an associated memory, one of a plurality of stored clutch modulation curves for use in increasing transmission hydraulic fluid pressure over time. For a full load, a clutch modulation curve is used which permits less time for the vehicle, which has more momentum to attain zero motion before changing gears i.e., for a heavy load, quick clutch engagement is desirable to inhibit clutch slip; for an empty load, a modulation curve is used which ramps up at a later point, as the vehicle has less momentum to eliminate. The controller controls the supply of hydraulic fluid to the clutch according to the selected curve.

According to another aspect of the invention, different clutch modulation curves are stored for forward and for reverse directions of travel.

A principal technical advantage of the invention is that the vehicle using the invention has acceptable responsiveness under all load conditions without dropping into gear abruptly.

BRIEF DESCRIPTION OF THE DRAWINGS

Further aspects of the invention will be discerned with reference to the following detailed description when taken in conjunction with the drawings, in which like characters identify like parts and in which.

DETAILED DESCRIPTION OF THE ILLUSTRATED EMBODIMENT

Figure 1:
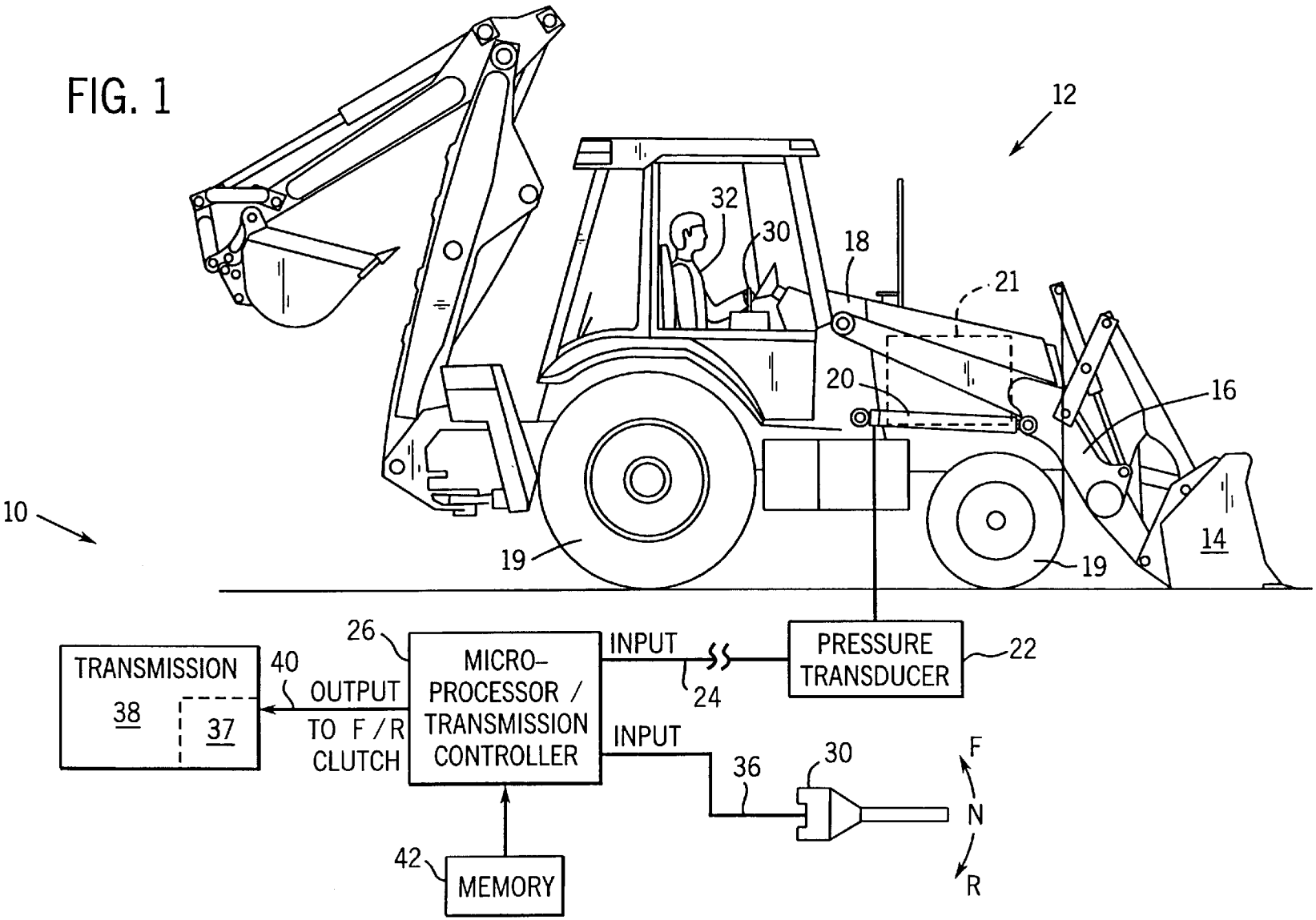
FIG. 1 is a schematic diagram showing an end loader employing the invention and certain control components.

In FIG. 1, a clutch pressure modulation system 10 according to the present invention has been fitted to a combination back hoe/end loader indicated generally at 12. The end loader 12 is equipped with a bucket 14 which is articulably connected to a pair of bucket arms 16 (one shown), which in turn are articulably attached to a chassis 18 of the end loader 12. Wheels 19 (alternatively, endless tracks) support the chassis off the ground. At least one, and preferably more, of these wheels 19 will be drive wheels driven by a hydraulic transmission 38. A prime mover, such as an internal combustion engine 21, selectively supplies torque to the drive wheel(s) through transmission 38. Per conventional practice, the motion and position of the bucket 14 is controlled by various sets of hydraulic cylinders. One set 20 (only one of two cylinders shown in this elevational view) of hydraulic cylinders is responsible for lifting the arms 16.

On one (as illustrated) or even both (one not shown) of the lift cylinders 20, a hydraulic fluid pressure sensor 22 is installed, in the illustrated embodiment a transducer which translates fluid pressure in the cylinder 20 to an electrical signal output on a communication path 24. The signal line or communications path 24, such as a communications bus, connects the transducer 22 to a controller 26 mounted at a convenient location on the vehicle.

Per conventional practice, the end loader 12 is fitted with a shifter 30, which minimally will have forward and reverse "speeds". The shifter may also have further speeds such as a first, second and third gear, for selecting various transmission gear ratios; this would be the case if the vehicle 12 were designed to travel any distance. The speed shifter 30 is operated by an operator 32 who selects in which direction the end loader 12 is to travel. The shifter 30 is connected by a communications path 36 to the controller 26. The shifter uses this communications path 36, which may be the same as the communications bus used by hydraulic fluid sensor 22, to transmit to the controller the speed which the operator has selected. Shifter 30 may, for example, have a signal with three possible values, indicative of a desired forward shift, a reverse shift or no shift.

The fluid pressure sensed by transducer 22 will be a function of the weight of the payload carried by bucket 14. Based on a sampling of the value of the payload weight signal on path 24 and the forward/reverse or "speed" signal on path 36, the controller selects one of a plurality of clutch modulation curves as will be explained in conjunction with FIGS. 2–3*f*. The retrieved clutch modulation curve is used by the controller 26 to modulate clutch engagement fluid pressure of a forward/reverse clutch 37 in a vehicle transmission 38. This is done via a control path 40 which connects the controller 26 to the transmission 38. The transmission 38, of course, selectively transmits power from the vehicle engine 21 to the drive wheel(s).

In one embodiment, the control signal transmitted along path 40 may be a pulse width modulated (PWM) signal which will cyclically actuate a solenoid gate valve in the transmission 38 to gradually increase pressure to the transmission clutch. To variably control the solenoid, the duty cycle of the PWM signal is adjusted by varying the width of the transmitted pulse. The PWM signal may originate from an integrated circuit specifically designed for this task which is incorporated into the conceptual controller circuit 26, the circuit 26 then having two or more integrated circuits in its makeup; alternatively, the controller 26 may be a single integrated circuit with the PWM function on-chip.

The controller 26 includes a processor, such as a microprocessor, and is connected to accompanying peripheral or on-chip devices such as DRAM, SRAM or SDRAM memory 42, communications buffers and interface circuitry, a nonvolatile memory such as a PROM, EPROM or EEPROM for storing the executable program instructions, a processor bus for linking these units together, and a DC power supply for supplying power to the foregoing. Since these components are conventional they will not be described in further detail here. Alternatively, instead of being made up of the above-described programmable electronic circuits, the controller 26 may be made up of one or more custom, hardwired integrated circuits designed and fabricated specifically for this purpose.

Figure 2:
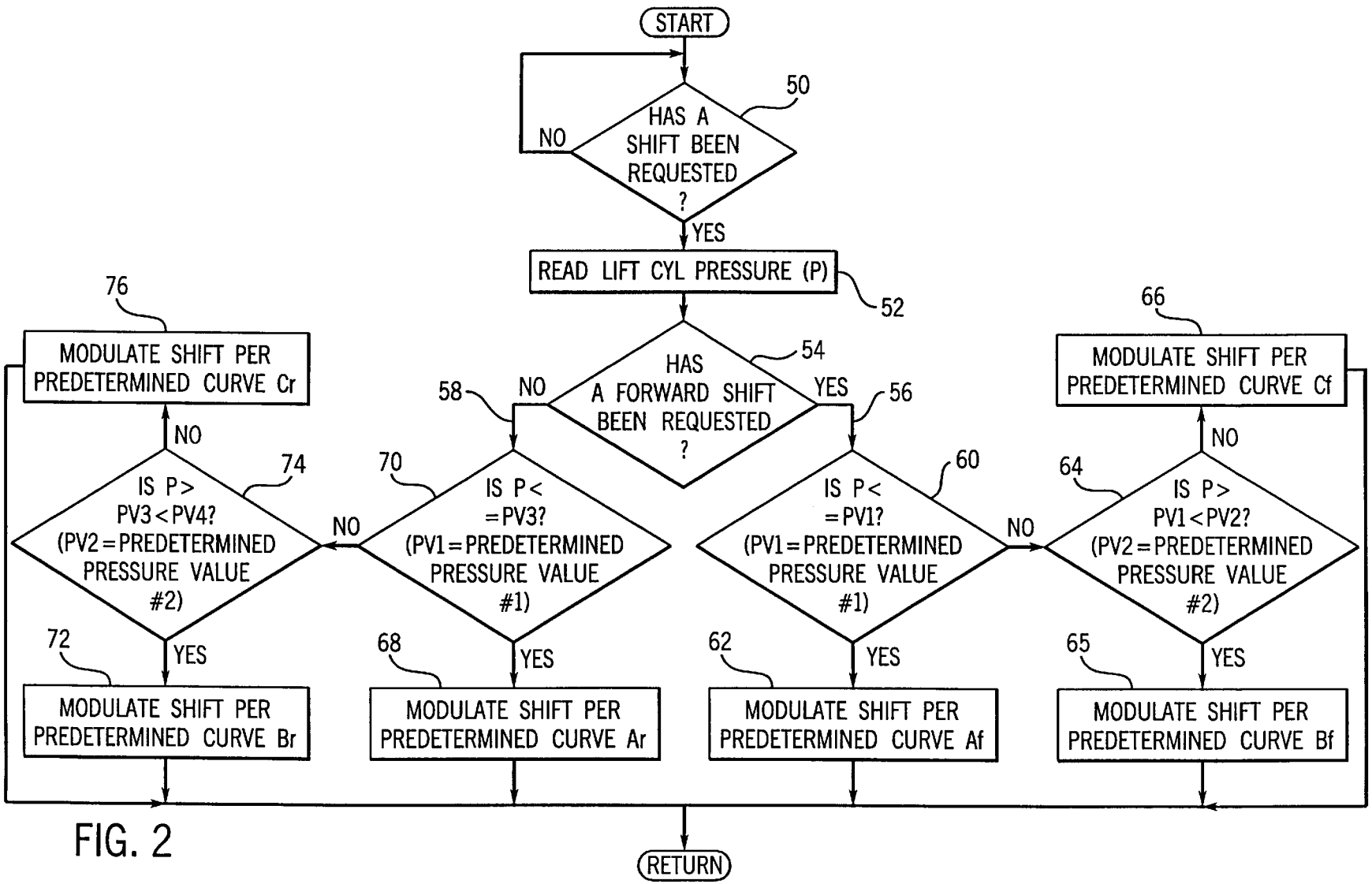
FIG. 2 is a flow diagram illustrating a clutch modulation curve selection algorithm according to the invention.

FIG. 2 is a schematic diagram of a stored program which may be used by the controller 26 to carry out the clutch modulation curve selection function. At step 50, the program inspects the state of a buffer associated with the input on line 24 (FIG. 1) to determine whether a shift has been requested; for example, the state of a stored bit in the buffer may change from 0 to 1 dependent on whether forward or reverse has been selected, and the controller can compare the current value in this buffer with a last value thereof stored elsewhere in memory. If there is no change, the program loops back to the next iteration; if there has been a change, the program continues to step 52.

At step 52, the program inspects and stores the contents of a buffer associated with pressure sensor signal path 24; the contents of this buffer will be indicative of lift cylinder pressure P in the bucket arm lift cylinder 20. Then, at step 54, the program asks whether a forward shift has been requested. This can be deduced from the present value communicated on shifter signal path. If a forward shift has been requested, the program branches to a path 56; otherwise, the shift requested must have been a reverse shift and the program branches to a path 58.

Path 56 leads to decision step 60, which determines whether lift cylinder pressure P is less than or equal to a predetermined constant PV1. If so, a predetermined clutch modulation curve A*f* is fetched at step 62. If not, the program branches to step 64, which queries whether pressure P is greater than PV1 but less than a second predetermined constant PV2. If it is, the program fetches a modulation curve B*f*; if not, the program fetches a modulation curve C*f* at step 66.

If reverse branch 58 had been selected, then a similar determination is made to choose among reverse modulation curves Ar, Br and Cr. Curve Ar will be selected at step 68 if, at step 70, the pressure P is determined to be less than or equal to a predetermined constant PV3; curve Br will be selected at step 72 if, at step 74, the pressure P is determined to be greater than PV3 but less than a predetermined constant PV4 which is greater than PV3; and curve Cr will be selected at step 76 if, at step 74, pressure P is determined to be greater than or equal to PV4.

Representative clutch modulation curves A*f*f, B*f*, C*f*, Ar, Br and Cr are shown in FIGS. 3*a*–3*f*, each depicting a graph of clutch fluid pressure versus time. In each case, the clutch fluid pressure starts, at the beginning of clutch actuation, at a prefill pressure. Thereafter, in the illustrated embodiment the clutch fluid pressure increases as a function of time until the clutch is at full pressure, in two linear segments with a discontinuity or bend. For a light machine, that is, for a machine not carrying any payload, pressure curve A*f* is selected. According to this modulation curve, the fluid pressure is increased from the prefill pressure at a relatively small slope until a pressure P1 is obtained at point 100; thereafter, the pressure is rapidly increased at a larger slope until full pressure is obtained.

Where the payload is in a moderate range, forward clutch modulation curve B*f* is selected. Curve Bf differs from curve A*f* in that a discontinuity point 102 in curve B*f* is higher in pressure than discontinuity point 100 in FIG. 3*a*, such that the curve increases clutch pressure at a more aggressive rate before the discontinuity point. When the payload is a heavy one, clutch modulation curve C*f* will be selected, showing an even more aggressive increase in pressure to a discontinuity point 104 that is even higher in pressure than discontinuity point 102 in B*f*. The basic premise is that, in going from "forward" to "reverse" or vice versa, to keep a similar rate of deceleration for a heavily loaded machine as a lightly loaded machine, the lightly loaded machine requires less clutch pressure to bring the machine to zero velocity. The discontinuity point is set at a pressure at which zero velocity is likely to be achieved, after which the vehicle will begin accelerating in the desired direction of travel. In an exemplary embodiment discontinuity points 100, 102, and 104, may be located at different positions along the times axes of clutch pressure modulation curves A*f*, B*f*, and C*f*, which begin at the time at which the pressure applied to the clutch rises from a prefill pressure.

Figure 3A:
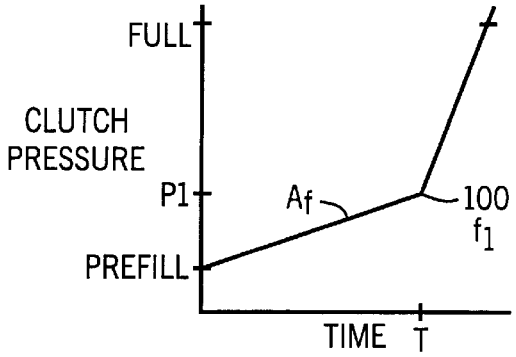
FIGS. 3*a*–3*f* are pressure/time graphs which are stored in the memory associated with one embodiment of a controller according to the invention.
Figure 3B:
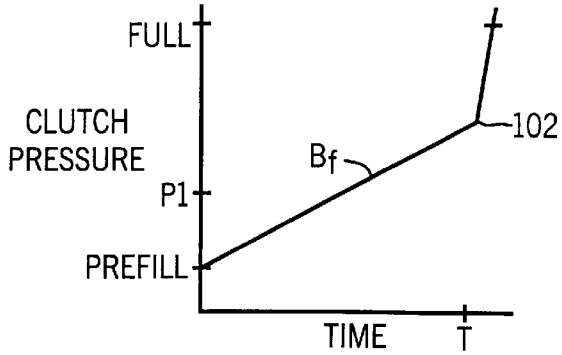
Figure 3C:
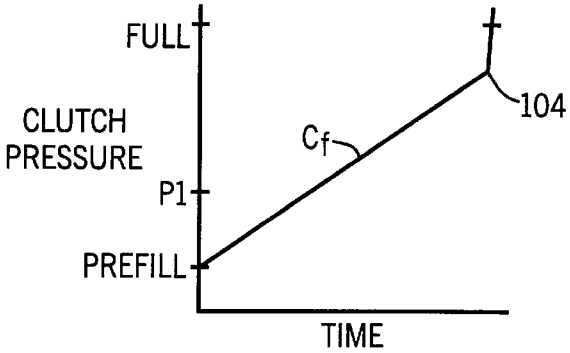
Figure 3D:
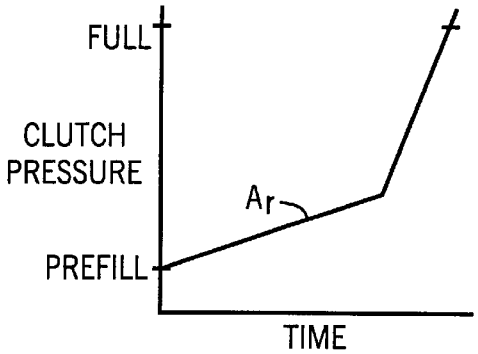
Figure 3E:
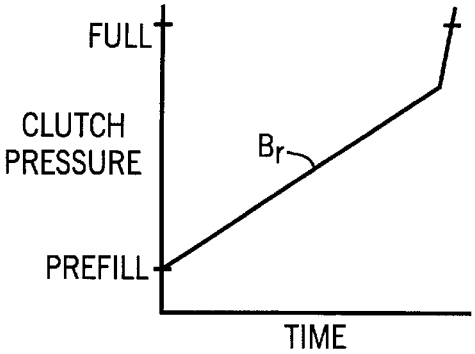
Figure 3F:
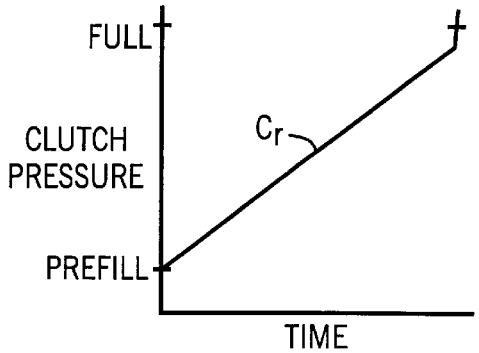

Reverse modulation curves Ar, Br and Cr, shown respectively in FIGS. 3*d*–3*f*, have a similar relation to each other. As the sensed lift cylinder pressure, and therefore payload, increases, the selected clutch pressure modulation curve will have a first segment which has a discontinuity point that is higher and higher in clutch pressure. In one embodiment, curves Ar, Br and Cr may be equal, respectively, to curves A*f*, B*f* and C*f*; in such an embodiment, there would be no need for the controller to sense in which direction the vehicle is to be moved, simplifying the modulation curve selection algorithm. In other embodiments (not shown), there may be more or fewer modulation curves from which to select, and may be of different shapes from those shown according to the characteristics of different vehicles and the conditions under which they are used. It is even possible for an operator or owner to select different sets of curves according to prospective operating conditions or a changed vehicle configuration.

While FIGS. 3*a*–3*f* show the clutch modulation curves as graphs, the curves are preferably stored in memory as lookup tables or vectors which return different values at different times during a shift. It is alternatively possible to store the curves as equations for line segments, as shown.

While the present invention has been described in conjunction with an end loader, it has application in any vehicle having a gross weight which may vary substantially according to the weight of the payload and which uses a hydraulic transmission. Thus, the present invention may have use in other earthmoving or materials handling construction equipment, in forklifts and the like, and in trucks. While preferred embodiments of the present invention have been described in the above detailed description, the invention is not limited thereto but only by the scope and spirit of the claims which follow.

We claim:

1. A clutch modulation system for a vehicle comprising:

a frame;

at least one drive wheel connected to said frame and operable to propel said vehicle in at least one direction of travel;

a transmission mounted on said frame and coupled to said at least one drive wheel and operable to transmit torque to said at least one drive wheel;

a prime mover mounted on said frame;

a transmission coupled to the prime mover and the transmission having a clutch;

a weight-lifting component movably mounted on said frame and adaptable to carry a payload, means coupling said weight-lifting component with respect to said frame including a hydraulic cylinder, a pressure in said hydraulic cylinder varying with the weight of the payload;

a sensor coupled to said hydraulic cylinder to sense the pressure experienced thereby, the sensor outputting a load signal in response to the sensed pressure;

a shifter operable by a vehicle operator, the shifter coupled to the transmission by the clutch to engage the engine to the drive wheels; and a controller coupled to the clutch, a memory coupled to the controller and adaptable to store a plurality of clutch modulation curves, each curve relating clutch pressure over time and each of the curves having a first segment with a first slope and a second segment having a second slope greater than the first slope, the second segment following the first segment in time;

the controller coupled to the sensor for receiving the load signal, the controller selecting one of the plurality of clutch modulation curves in response to the value of the load signal, the controller modulating operation of the clutch according to the selected clutch modulation curve.

2. The vehicle of claim 1, in which the controller modulates operation of the clutch by applying a pulse width modulated signal to a hydraulic fluid valve of the clutch.

3. The vehicle of claim 1, wherein the weight-lifting component comprises a bucket.

4. The vehicle of claim 1, wherein said at least one drive wheel directly contacts the ground.

5. The vehicle of claim 1, wherein the vehicle is selected from the group consisting of backhoes and end loaders.

6. A vehicle operable to carry a payload and to travel in forward and reverse directions, comprising:

a frame, a prime mover mounted on the frame to provide a source of motive power, at least one drive wheel rotatably coupled to the frame for moving the vehicle in the forward and reverse directions;

a transmission operable to transmit torque to the at least one drive wheel, the transmission coupled to the prime mover, the transmission including a clutch, a shifter operable by a vehicle operator to shift between forward and reverse directions and generating a directional signal indicative of a forward shift, a reverse shift or no shift;

a payload carrier operable by the operator to receive a payload, means coupled to the carrier for sensing the payload weight and generating a payload weight signal in response thereto;

a controller coupled to the means for sensing for receiving the payload weight signal, coupled to the shifter for sensing the directional signal, and coupled to the clutch for regulating clutch pressure; and a memory coupled to the controller and storing a plurality of clutch modulation curves each representing a variation of clutch pressure with respect to time, the controller selecting one of the clutch modulation curves as a function of the directional signal and the payload weight signal, the controller regulating clutch pressure according to the selected clutch modulation curve.

7. The vehicle of claim 6, wherein the payload weight carrier is articulably connected to the frame by means including at least one hydraulic cylinder, a hydraulic fluid pressure sensor connected to the hydraulic cylinder and generating the payload weight signal in response thereto, the fluid pressure experienced by the hydraulic cylinder varying according to the payload weight borne by the payload carrier.

8. The vehicle of claim 6, wherein the prime mover is an internal combustion engine.

9. The vehicle of claim 8, wherein the vehicle is selected from the group consisting of backhoes and end loaders, the payload carrier comprising a bucket articulably coupled to the frame by means including the hydraulic cylinder.

10. In a construction vehicle having a frame and a plurality of drive wheels capable of moving the vehicle over the ground in forward and reverse directions, a prime mover mounted on the frame, a transmission mounted on the frame, the transmission including a clutch, the transmission coupled to the prime mover and the drive wheels, a payload carrier operable to pick up and deposit a payload, and at least one hydraulic cylinder articulating the payload carrier with respect to the frame and experiencing a load varying with the mass of the payload, a clutch pressure modulation system comprising:

a shifter operable by the operator to indicate a direction of travel, the shifter generating a forward signal in response to the operator shifting into a forward direction and a reverse signal in response to the operator shifting into a reverse direction;

a controller coupled to the shifter for receiving the forward and reverse signals and coupled to the clutch for transmitting thereto a clutch pressure modulation signal, a memory coupled to the controller for storing a plurality of forward clutch pressure modulation curves and reverse clutch pressure modulation curves; and a pressure sensor mounted on the hydraulic cylinder, the pressure sensor coupled to the controller for transmitting thereto a load signal varying with the weight of the payload, the controller selecting one of the forward clutch modulation curves in response to receiving a forward signal and as a function of the value of the load signal, the controller selecting one of the reverse clutch modulation curves in response to receiving a reverse signal and as a function of the value of the load signal, the controller controlling the clutch pressure according to the selected curve.

11. The clutch pressure modulation system of claim 10, wherein the memory stores at least three forward clutch pressure modulation curves and at least three reverse clutch pressure modulation curves.

12. In a construction vehicle having a frame and a plurality of drive wheels capable of moving the vehicle over the ground in forward and reverse directions, a prime mover mounted on the frame, a transmission mounted on the frame, and including a clutch, the transmission coupled to the prime mover and the drive wheels, a payload carrier operable to pick up and deposit a payload, and at least one hydraulic cylinder articulating the payload carrier with respect to the frame and experiencing a load varying with the mass of the payload, a clutch pressure modulation system comprising:

a shifter operable by the operator to indicate a direction of travel, the shifter generating a forward signal in response to the operator shifting into a forward direction and a reverse signal in response to the operator shifting into a reverse direction;

a controller coupled to the shifter for receiving the forward and reverse signals and coupled to the clutch for transmitting thereto a clutch pressure modulation signal, a memory coupled to the controller for storing a plurality of forward clutch pressure modulation curves and reverse clutch pressure modulation curves; and a pressure sensor mounted on the hydraulic cylinder, the pressure sensor coupled to the controller for transmitting thereto a load signal varying with the weight of the payload, the controller selecting one of the forward clutch modulation curves in response to receiving a forward signal and as a function of the value of the load signal, the controller selecting one of the reverse clutch modulation curves in response to receiving a reverse signal and as a function of the value of the load signal, the controller controlling the clutch pressure according to the selected curve, wherein each of the clutch modulation curves graphs pressure with respect to time, each of the curves having a first segment with a first slope, and a second segment following the first segment, the second segment having a second slope greater than the first slope.

13. A method of modulating pressure applied to a clutch in a transmission of a vehicle, comprising the steps of:

coupling a payload weight sensor to a payload weight carrier of the vehicle;

transmitting a payload weight signal from the payload weight sensor to a controller;

using a shifter to generate a direction signal indicative of a forward direction or a reverse direction;

storing a plurality of forward clutch pressure modulation curves and a plurality of reverse clutch pressure modulation curves in a memory coupled to the controller;

selecting one of the stored clutch pressure modulation curves as a function of the value of the payload weight signal and the value of the direction signal;

using the selected clutch pressure modulation curve to regulate hydraulic fluid pressure applied to the clutch in the transmission.

14. A method of modulating pressure applied to a clutch in a transmission of a vehicle, comprising the steps of:

coupling a payload weight sensor to a payload weight carrier of the vehicle;

transmitting a payload weight signal from the payload weight sensor to a controller;

storing a plurality of clutch pressure modulation curves in a memory coupled to the controller, each of the plurality of clutch pressure modulation curves being for a range of payloads and having a discontinuity point intended to match a time of zero velocity of the vehicle for that range of payloads when the vehicle is going in a direction opposite the desired direction, each of the plurality of clutch pressure modulation curves being differentiated from the other clutch pressure modulation curves by the position of the discontinuity point along a time axis beginning with the time at which the pressure applied to the clutch rises from a prefill pressure;

selecting one of the stored clutch pressure modulation curves as a function of the value of the payload weight signal;

using the retrieved clutch pressure modulation curve to regulate the hydraulic fluid pressure applied to the clutch in the transmission.

* * * * *